US006413582B1

(12) United States Patent
Park et al.

(10) Patent No.: US 6,413,582 B1
(45) Date of Patent: Jul. 2, 2002

(54) METHOD FOR FORMING METALLIC-BASED COATING

(75) Inventors: Dong-Sil Park, Niskayuna, NY (US); D. Sangeeta, Cincinnati, OH (US); Yuk-Chiu Lau, Ballston Lake, NY (US); Theodore Robert Grossman, Hamilton, OH (US); David Alan Nye, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/345,543

(22) Filed: Jun. 30, 1999

(51) Int. Cl.[7] ..... B05D 7/22
(52) U.S. Cl. ..... 427/235; 427/238
(58) Field of Search ..... 427/235, 238

(56) References Cited

U.S. PATENT DOCUMENTS

| | | | | |
|---|---|---|---|---|
| 3,720,537 A | * | 3/1973 | Rigney | 427/229 |
| 3,978,251 A | * | 8/1976 | Stetson et al. | 427/229 |
| 4,208,454 A | | 6/1980 | Reed et al. | |
| 4,241,113 A | * | 12/1980 | Martinengo et al. | 148/535 |
| 4,308,160 A | | 12/1981 | Baldi | |
| 4,426,248 A | | 1/1984 | Jackson | |
| 4,888,213 A | | 12/1989 | Hesterberg | |
| 5,165,970 A | * | 11/1992 | Schmidt et al. | 427/430.1 |
| 5,215,785 A | * | 6/1993 | Strasser et al. | 427/230 |
| 5,366,765 A | * | 11/1994 | Milaniak et al. | 427/229 |
| 5,514,482 A | * | 5/1996 | Strangman | 428/623 |
| 5,650,235 A | * | 7/1997 | McMordie et al. | 428/610 |
| 5,762,997 A | * | 6/1998 | Hara et al. | 427/64 |
| 5,807,428 A | | 9/1998 | Bose et al. | |
| 5,824,366 A | | 10/1998 | Bose et al. | |

FOREIGN PATENT DOCUMENTS

DE 3834907 5/1989

OTHER PUBLICATIONS

European Search Report.

* cited by examiner

*Primary Examiner*—Shrive P. Beck
*Assistant Examiner*—Michael Cleveland
(74) *Attorney, Agent, or Firm*—Paul J. DiConza; Donald S. Ingraham

(57) ABSTRACT

A method for coating an internal surface of a substrate includes providing a substrate having an internal surface, coating a slurry on the internal surface, the slurry containing a metallic powder, and drying the slurry such that the slurry forms a metal-based coating on the substrate.

42 Claims, 1 Drawing Sheet

Al Slurry/SS 5251B02 15kV/200X

Al Slurry/SS 5251B01 15kV/40X

Al Slurry/SS 5251B02 15kV/200X

METHOD FOR FORMING METALLIC-BASED COATING

BACKGROUND OF THE INVENTION

The invention relates generally to metallurgical processes. More specifically, it is directed to coating processes for substrates such as turbine engine components.

A variety of specially-formulated coatings is often used to protect metal parts that are exposed to high temperatures, e.g., metal parts made from superalloys. For example, aluminide coatings are often used to improve the oxidation- and corrosion-resistance of superalloy materials. In aluminide coatings, the aluminum forms an aluminum oxide (alumina) film on its surface, which functions as a barrier to further oxidation. Such coatings may also serve as a bond coat between the superalloy substrate and a thermal barrier coating (TBC).

Several processes for depositing aluminide layers are available for both newly formed components and components under repair. Such processes include vapor phase deposition techniques and what is known in the art as the 'pack cementation process'. The vapor phase techniques are suitable for coating external surfaces of a component, but have not been generally effective for coating internal surfaces, such as internal passageways of a turbine engine component. While the pack cementation process is effective at coating internal surfaces of a component, this process is expensive, time consuming, and requires highly specialized equipment, generally requiring the component to be shipped from the job site to an outside service provider in the case of components under repair.

Accordingly, a need exists in the art for further improved and alternative methods for forming aluminide coatings.

SUMMARY OF THE INVENTION

According to one aspect of the invention, a method for coating an internal surface of a substrate is provided. The method includes coating a slurry on an internal surface of a substrate, the slurry containing a metallic powder, and drying the slurry such that the slurry forms a metal-based coating on the substrate.

DETAILED DESCRIPTION OF THE INVENTION

Figure 1:
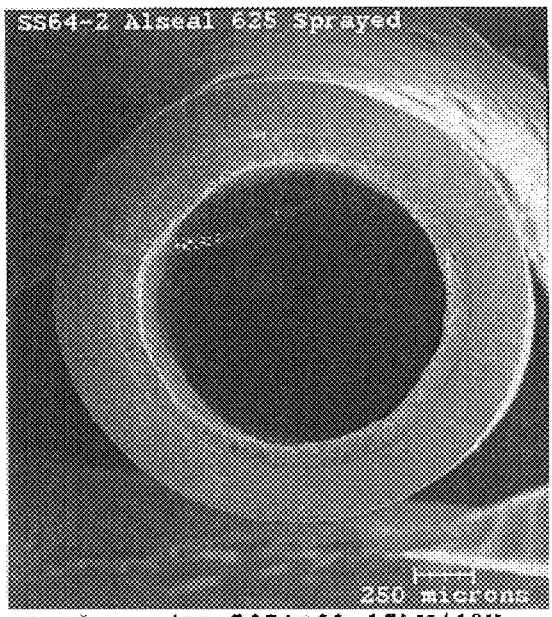
FIG. 1 is an SEM micrograph of an example having an aluminide coating on an internal passageway.

Embodiments of the present invention are drawn to methods for coating a substrate, particularly methods for forming a metallic coating on an internal surface of a substrate. The substrate is typically formed of an alloy, and is in the form of a turbine engine component. Exemplary substrates are formed of superalloy materials, known for high temperature performance in terms of tensile strength, creep resistance, oxidation resistance, and corrosion resistance, for example. The superalloy component is typically formed of a nickel-base or a cobalt-base alloy, wherein nickel or cobalt is the single greatest element in the superalloy by weight.

Illustrative nickel-base superalloys include at least about 40 wt % Ni, and at least one component from the group consisting of cobalt, chromium, aluminum, tungsten, molybdenum, titanium, and iron. Examples of nickel-base superalloys are designated by the trade names Inconel®, Nimonic®, Rene® (e.g., Rene®80-, Rene®95, Rene®142, and Rene®N5 alloys), and Udimet®, and include directionally solidified and single crystal superalloys. Illustrative cobalt-base superalloys include at least about 30 wt % Co, and at least one component from the group consisting of nickel, chromium, aluminum, tungsten, molybdenum, titanium, and iron. Examples of cobalt-base superalloys are designated by the trade names Haynes®, Nozzaloy®, Stellite® and Ultimet®.

The term "aluminide" or "aluminide-containing" as used herein is meant to include a variety of aluminum-containing materials that are typically used in coating metal alloys (especially superalloys), or which are formed during or after the coating process. Non-limiting examples include aluminum, platinum aluminide, nickel aluminide, platinum-nickel aluminide, refractory-doped aluminides, or alloys which contain one or more of those compounds.

The term "internal surface" of the substrate denotes a surface or surface portion that is not generally exposed to an exterior of the substrate, and is difficult to access or manipulate from an exterior of the substrate. While internal surfaces include cavities and passageways, typically internal surfaces that are treated according to embodiments of the present invention are passageways, elongated openings each having an inlet and an outlet. The terms "inlet" and "outlet" denote first and second opposite openings of the passageway. The terms are relative in that they may be assigned to the opposite openings arbitrarily depending on the particular perspective and any intended gas flow through the passageway during actual use of the component incorporating the substrate. The substrate may have a plurality of internal passageways, such as in the case of an airfoil for a turbine engine.

The passageway typically has a high aspect ratio, generally not less than 5, and typically not less than about 10. According to particular embodiments of the present invention, the aspect ratio is not less than about 20, such as not less than about 40. The aspect ratio is defined as the ratio of the length of the passageway divided by the minimum cross-sectional dimension of the passageway. The passageway may be straight or have a curved contour, including complex curved contours, such as serpentine passageways. In such a case, the length of the passageway is defined by the actual path length of the passageway, not the straight-line distance between the ends (i.e., the inlet and the outlet).

The term "minimum cross-sectional dimension" denotes the smallest dimension of the passageway in cross-section. In the case of an annular passageway, the minimum cross-sectional dimension is the diameter of the passageway taken at a cross section having the smallest cross-sectional area along the entire length of the passageway. According to an embodiment of the present invention, the internal passageway is generally annular, that is, circular in cross-section, and has a minimum diameter within a range of about 10 mils to about 400 mils. Further, typical internal passageways have a length within a range of about 3 inches to about 30 inches, such as about 6 inches to about 20 inches.

According to an embodiment of the present invention, a method for forming a metal-based coating on the internal passageway of a substrate calls for first coating a slurry along the internal passageway. The slurry contains a metallic powder, preferably an aluminum powder, although other metallic powders may be used depending on the end use of the component. The aluminum powder has an average particle size $d_{50}$ within a range of about 1 to about 75 microns, such as about 1 to 20 microns, or about 1.0 micron to about 15 microns. In one particular example, the slurry has an average particle size of about 7 microns. The slurry can be loaded with a varying proportion of aluminum powder, depending upon the desired rheological properties of the slurry, coating thickness, etc. According to one embodiment, the slurry contains about 30.0 to about 45.0 wt. % aluminum powder in an aqueous solution. The slurry may further contain additional powders such as silicon, within a range of about 2.0 to about 8.0 wt. %. In one particular form, the aqueous solution contains a chromate and a phosphate. More particularly, the slurry contains about 1.0 to about 6.0 wt. % chromate, and about 15.0 to about 25.0 wt. % phosphate. In an alternative embodiment, the slurry is non-aqueous, containing an organic liquid medium in which the metallic powder is suspended rather than an aqueous-based liquid medium. Examples of organic liquid mediums include toluene, acetone, various xylenes, alkanes, alkenes, and their derivatives. The slurry typically has a viscosity not greater than about 80 centipoise, typically not greater than 50 centipoise.

The slurry may be coated on the internal surface or surfaces by various techniques. Manual techniques, such as using a plastic dropper or other dispensing means can be used to dispense the slurry within the internal passageway. Coatings having improved uniformity and repeatability are typically formed by applying the slurry in an automated fashion, rather than manually, For example, the slurry may be applied by utilizing a pump to circulate the slurry through the passageway. The automated system is typically closed-looped, so as to reduce slurry waste.

Following application of the slurry to the internal passageway, excess slurry is removed from the passageway. In this regard, the present inventors have identified that excess slurry tends to result in the formation of a non-uniform coating in the passageway, having non-uniform thickness and/or smoothness characteristics. In addition, excess slurry can cause physical blockage of the passageway following drying and/or heating to form the metal-based coating. Further, it was found that in particularly elongated passages, including passages having a non-linear internal path, it is generally difficult to remove excess slurry by draining, that is, by orienting the substrate and permitting excess slurry to drain out by force of gravity. Therefore, according to a particular embodiment of the invention, flow of a gas through the passageway is initiated to remove excess slurry from the passageway.

Although the gas is typically ambient air or compressed air, other gases may be used. For example, to minimize or eliminate unwanted reactions between the gas and the slurry, an inert gas may be used. The gas flow is initiated by various means. For example, in one embodiment, a vacuum source is applied to the outlet of the passageway, causing ambient air and excess slurry to flow into the vacuum source. Alternatively, forced air from a compressed air source is applied to the inlet of the passageway to remove excess slurry via flow of the forced air. In either case, the forced air or the vacuum is typically applied to the passageway through a nozzle that fits into the passageway. Alternatively, the forced air or vacuum is applied globally, to an entire side of the substrate, for example, to all of the inlets or outlets simultaneously.

The flow rate and flow duration of the gas passing through the passageway are chosen based on several parameters, including the minimum and maximum cross-sectional areas of the passageway, length of the passageway, the desired thickness of the metal-based coating, surface tension, viscosity, and other rheological properties of the slurry. The flow rate should not be so high so as to remove too much of the slurry and leave behind too thin a coating. On the other hand, the flow rate should be high enough to ensure removal of the unwanted slurry. In one embodiment, the gas flow is within a range of about 0.1 cubic feet per minute (cfm) to about 20 cfm, such as about 0.1 cfm to about 10 cfm. In one particular example, the gas flow rate is about 1.0 cfm. Compressed lab air commonly available within chemical laboratories is typically within this range. The duration of the gas flow is typically on the order of about 10 seconds to about 30 minutes.

Following flow of the gas through the passageway, the slurry is dried to drive evaporation of the liquid medium of the slurry and form a dried, metal-based coating. As used herein, the term "metal-based" is used to indicate a material in which a metal component is the single greatest component in the coating by weight, sum of several metallic components form the largest weight percentage in the coating. Metallic components include metallic elements and alloys. Drying can be done at room temperature, but is generally done at an elevated temperature to reduce drying time to the order of several minutes. For example, the drying temperature is typically elevated to a temperature within a range of about 95° F. (35° C.) to about 392° F. (200° C.). In one embodiment, drying was carried out at about 80° C. for ten minutes. Drying at elevated temperatures is typically referred to as a "pre-sintering" or "pre-baking" step. Even higher temperatures can be employed to bake any binder contained in the original slurry, such as on the order of 500° F. (260° C.). Drying alternatively is carried out as part of a sintering procedure, employing either a slow initial ramp-up of temperature or a temperature hold to accommodate drying.

In cases where an increased thickness of the metal-based coating is desired, that is, where a single application of the slurry is not adequate to provide a fully functional coating, the steps of coating the slurry, removing excess slurry by purging or gas flow, and drying may be repeated plural times. By such a process, each application of this series of steps is effective to increase the coating thickness by the approximate value of the original coating. For example, three series of steps provides a coating of approximately 3 times (3×) the initial thickness. Repetition of the steps is advantageous for certain applications, such as in the case of forming an aluminide coating for a turbine engine component. In this case, typically the average thickness is not less than about 0.5 mils, such as about 0.5 mils to about 10 mils.

Following drying, the substrate having the dried, metallic-based coating thereon, is further heated to sinter or bake the coating, to densify the coating. The sintering temperature is largely dependent on the particular metallic material of the coating, as well as the intended environment of the treated substrate. The coating may be subjected to high temperatures to form a diffusion coating, more specifically a "high-temperature" aluminide diffusion coating. Typical diffusion temperatures are generally not less than 1600° F. (870° C.), such as within a range of about 1800° F. (982° C.) to about 2100° F. (1149° C.). Such diffusion coatings provide high temperature oxidation and corrosion resistance to turbine components. The elevated temperature causes the aluminum to melt and diffuse into the underlying substrate to form various intermetallics. In the case of a nickel-base superalloy substrate, the aluminum diffuses and bonds with the nickel to form various nickel-aluminide alloys. In some embodiments, a precious metal such as platinum is first deposited over the substrate prior to application of the aluminum-based slurry as described herein. In this case, the aluminum is diffused to form platinum aluminide intermetallics, as well as nickel aluminide intermetallics and platinum nickel aluminide intermetallics.

The following examples are illustrative, and should not be construed to be any sort of limitation on the scope of the claimed invention. Use of tubes in the following examples model internal passageways typically found in a substrate such as a turbine engine component, including airfoils.

EXAMPLE 1

A 304 stainless steel tube, 0.064 inches inside diameter (ID), ×0.009 inches wall thickness, was cut to a length of 6 inches, and was etched in a 50% hydrochloric acid (HCl) aqueous solution at 122° F. (50° C.) for 5 minutes, and rinsed with distilled water and dried. An aluminum slurry was thoroughly mixed, and sucked into a plastic dropper (approximately 3 cc of the slurry). The slurry had a nominal composition of 37.7 wt. % aluminum (Al), 4.2 wt. % silicon (Si), and 58.1 wt. % of a phosphate and chromate aqueous solution, and had a viscosity of about 20 centipoise. The tip of the plastic dropper was inserted into one end of the stainless steel tube, and the aluminum slurry was allowed to flow into the tube. After applying the slurry into the tube, one of the opposite ends of the tube was blown with laboratory compressed air for 2 minutes to remove excess slurry. Visual inspection confirmed that the tube had no blockage. The tube was weighed, pre-baked at about 175° F. (80° C.) for 10 minutes in ambient air, cooled and reweighed. The steps of applying the slurry, applying compressed air, and pre-baking (drying) were repeated 6 times. The weight gain following each series of steps was within a range of 2.3 to 3.5 mg/cm$^2$. The percent weight retention after each of the pre-baking steps was within a range of 80.6 to 89.8 wt. %, indicating drying of the slurry. The tube was then further baked at about 500° F. (260° C.) for 10 minutes in air, and was then cut into 1" long segments to examine the coating for uniformity.

Figure 2:
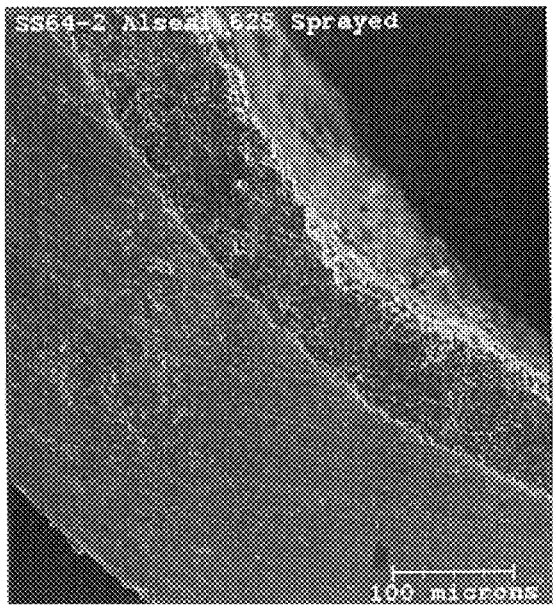
FIG. 2 is an exploded view of FIG. 1, illustrating the aluminide coating in more detail.

FIGS. 1 and 2 show scanning electron microscope (SEM) photographs of the segment at the middle of the 6" long tube. FIGS. 1 and 2 illustrate a uniform coating, and other segments similarly had high-quality, uniform coatings.

EXAMPLE 2

A 304 stainless steel tube having a 0.042 inch ID×0.010 inch wall thickness was cut to a length of 6 inches. Processing then continued following the same manner as the processing in Example 1. The weight gain after each series of steps fell within a range of 2.7 to 3.0 mg/cm$^2$, and the weight retention following the 175° F. (80° C.) pre-bake fell within a range of 84.8 to 90.8 wt. %. Visual inspection confirmed that the tube was free of any blockage. Following the baking step at 500° F. (260° C.), cross-sections were found to have coating uniformity similar to that of Example 1.

EXAMPLE 3

The procedure of Example 1 was repeated with GTD 111 (9.50 Co, 14.00 Cr, 3.00 Al, 4.90 Ti, 2.80 Ta, 1.50 Mo, 3.80 W, 0.01 C, 0.04 Zr, 0.01 B) tubes having the following dimensions: 0.060 inch ID×0.010 inch wall thickness, and 0.100 ID×0.010 inch wall thickness. Following the processing of EXAMPLE 1, the coated tubes were heat treated at about 2012° F. (1100° C.) for 4 hours in argon. Cross sections confirmed that uniform diffusion coatings were formed.

EXAMPLES 4–6

Further testing of stainless steel tubes having larger diameters, up to about 0.105 inches ID, and a length of up to 10 inches also showed similar results having coatings of uniform thickness and surface roughness. Pure nickel tubes having a 0.064 inch ID and 0.105 inch ID were also tested and showed similar results. In addition, further testing of more dilute and more concentrated aluminum-based slurries were also tested. As expected, similar results were also demonstrated for these slurries. It was also shown that the weight gain per application of slurry was directly proportional to the solid concentration of the slurry.

Comparative Example

The procedure of Example 1 was repeated, except that the application of compressed air was replaced by draining of the tube by gravity. According to the comparative example, the tube showed blockage at one of the opposite ends following the second application of slurry. The comparative example demonstrated that draining of the excess slurry by gravity alone was insufficient to form a uniform coating.

Various embodiments of this invention have been described herein. However, this disclosure should not be deemed to be a limitation on the scope of the claimed invention. Accordingly, various modifications, adaptations, and alternatives may occur to one skilled in the art without departing from the scope of the present claims.

What is claimed:

1. A method for coating at least one internal passageway of a turbine engine component, comprising the steps of:

providing a substrate, said substrate comprising a turbine engine component having at least one internal surface, said at least one internal surface comprising at least one internal passageway, said at least one passageway extending through said turbine engine component;

coating a slurry on the at least one internal passageway, the slurry containing a metallic powder;

flowing a gas through said at least one internal passageway to remove excess slurry in said at least one internal passageway;

drying the slurry such that the slurry forms a metal-based coating on the substrate; and sintering said metal-based coating by heating to a sintering temperature to densify the coating.

2. The method of claim 1, wherein the gas is supplied from a compressed gas source.

3. The method of claim 1, wherein the flowing of the gas is carried out by applying a vacuum source to the at least one internal passageway.

4. The method of claim 3, wherein the substrate is placed in ambient air and the vacuum causes ambient air to flow through the at least one internal passageway.

5. The method of claim 1, wherein the gas is flowed through the at least one internal passageway at a rate of about 0.1 cfm to about 20 cfm.

6. The method of claim 1, wherein the substrate comprises a plurality of internal passageways.

7. The method of claim 1, wherein the steps of coating, flowing, and drying are repeated plural times to increase the thickness of the metal-based coating.

8. The method of claim 7, wherein the step of drying is carried out by pre-sintering the substrate at a temperature not less than about 35° C.

9. The method of claim 1, wherein the at least one internal passageway has an aspect ratio of not less than 5, the aspect ratio being a ratio of length of the at least one internal passageway divided by the minimum cross-sectional dimension of the at least one internal passageway.

10. The method of claim 9, wherein the at least one internal passageway is generally circular in cross-section, and the minimum cross-sectional dimension is the minimum diameter.

11. The method of claim 9, wherein the aspect ratio is not less than about 10.

12. The method of claim 11, wherein the aspect ratio is not less than about 20.

13. The method of claim 12, wherein the aspect ratio is not less than about 40.

14. The method of claim 1, wherein the at least one internal passageway is generally circular in cross-section and the internal passageway has a minimum diameter of about 10 mils to about 400 mils.

15. The method of claim 1, wherein the metal-based coating has an average thickness not less than about 0.5 mils.

16. The method of claim 15, wherein the metal-based coating has an average thickness within a range 0.5 mils to about 10 mils.

17. The method of claim 1, wherein the substrate comprises an alloy.

18. The method of claim 1, wherein the turbine engine component is an airfoil, and the at least one internal surface is a plurality of internal passageways.

19. The method of claim 1, wherein the turbine engine component comprises a superalloy.

20. The method of claim 19, wherein the superalloy comprises a nickel-based or a cobalt-based superalloy, wherein nickel or cobalt is the single greatest element in the superalloy by weight.

21. The method of claim 20, wherein the superalloy is nickel-based.

22. The method of claim 1, wherein the metallic powder comprises aluminum.

23. The method of claim 22, wherein the slurry contains 30.0 to 45.0 wt % aluminum, 2.0 to 8.0 wt % silicon, and a balance of an aqueous solution.

24. The method of claim 23, wherein the solution contains a chromate and a phosphate.

25. The method of claim 24, wherein the slurry contains 1.0 to 6.0 wt % chromate, and 15.0 to 25.0 wt % phosphate.

26. The method of claim 22, wherein the aluminum powder has an average particle size within a range of about 1.0 micron to about 15 microns.

27. The method of claim 1, wherein the metallic powder comprises aluminum, and the method further comprises a step of subjecting the substrate to a high-temperature diffusion treatment to diffuse aluminum into the substrate.

28. The method of claim 27, wherein a precious metal is first deposited over the at least one internal passageway, prior to coating the slurry on the at least one internal passageway.

29. The method of claim 28, wherein the precious metal is platinum, and the substrate is formed of a material comprising nickel.

30. The method of claim 29, wherein the diffusion of aluminum into the substrate forms at least one compound selected from the group consisting of platinum-aluminide intermetallics, nickel-aluminide intermetallics, and platinum-nickel-aluminide intermetallics.

31. The method of claim 1, wherein the slurry has a viscosity not greater than about 80 centipoise.

32. The method of claim 31, wherein the slurry has a viscosity not greater than about 50 centipoise.

33. A method for coating internal passageways of a turbine engine component, comprising the steps of:

providing a turbine engine component having internal passageways;

coating a slurry on the internal passageways, the slurry containing an aluminum powder;

flowing a gas through the internal passageways to remove excess slurry in the internal passageways;

drying the slurry such that the slurry forms an aluminum-based coating along the internal passageways;

repeating the steps of coating, flowing, and drying a plurality of times; and sintering said aluminum-based coating by heating to a sintering temperature to densify the aluminum-based coating.

34. The method of claim 33, wherein the internal passageways have an aspect ratio of not less than 5, the aspect ratio being a ratio of length of a respective internal passageway divided by the minimum cross-sectional dimension of the respective internal passageway.

35. The method of claim 34, wherein the internal passageways are generally circular in cross-section, and the minimum cross-sectional dimension is a minimum diameter.

36. The method of claim 34, wherein the aspect ratio is not less than about 10.

37. The method of claim 34, wherein the aspect ratio is not less than about 20.

38. The method of claim 34, wherein the aspect ratio is not less than about 40.

39. The method of claim 33, wherein the turbine engine component is an airfoil.

40. The method of claim 33, further comprising a step of subjecting the turbine engine component to a diffusion treatment to diffuse aluminum into the turbine engine component.

41. The method of claim 40, wherein the diffusion treatment is carried out at a temperature of not less than 870° C.

42. A method for coating the surface of an internal passageway within a turbine engine component, consisting essentially of the steps of:

providing a substrate, said substrate comprising a turbine engine component having at least one internal passageway;

coating a slurry on the surface of said at least one internal passageway, said slurry containing a metallic powder;

flowing a gas through the at least one internal passageway to remove excess slurry in the at least one internal passageway;

drying the slurry such that the slurry forms a metal-based coating on the surface of the at least one internal passageway; and sintering said metal-based coating by heating to a sintering temperature to densify the coating.

* * * * *